US007713401B2

(12) United States Patent
Lister et al.

(10) Patent No.: US 7,713,401 B2
(45) Date of Patent: May 11, 2010

(54) METHODS FOR PERFORMING ELECTROCHEMICAL NITRATION REACTIONS

(75) Inventors: Tedd Edward Lister, Idaho Falls, ID (US); Robert Vincent Fox, Idaho Falls, ID (US)

(73) Assignee: Battelle Energy Alliance, LLC, Idaho Falls, ID (US)

( * ) Notice: Subject to any disclaimer, the term of this patent is extended or adjusted under 35 U.S.C. 154(b) by 56 days.

(21) Appl. No.: 11/836,009

(22) Filed: Aug. 8, 2007

(65) Prior Publication Data

US 2009/0038953 A1 Feb. 12, 2009

(51) Int. Cl.
*C25B 1/00* (2006.01)
*C25B 3/00* (2006.01)

(52) U.S. Cl. ..... 205/431; 205/357; 205/360; 205/362; 205/413

(58) Field of Classification Search ..... 568/711, 568/924, 944, 950, 952, 953; 205/357, 432, 205/360, 362, 413, 431
See application file for complete search history.

(56) References Cited

U.S. PATENT DOCUMENTS

| | | | | |
|---|---|---|---|---|
| 2,997,504 | A | 8/1961 | Shechter et al. | |
| 4,594,430 | A * | 6/1986 | Grakauskas et al. | 549/9 |
| 4,910,322 | A | 3/1990 | Grakauskas et al. | |
| 5,128,000 | A * | 7/1992 | Klotz et al. | 205/485 |
| 2005/0051438 | A1 | 3/2005 | Pitner et al. | |
| 2006/0049064 | A1 | 3/2006 | Horvath et al. | |

FOREIGN PATENT DOCUMENTS

| | | | |
|---|---|---|---|
| PL | 103621 B1 * | 6/1979 | |
| WO | WO 2006/085319 | 8/2006 | |

OTHER PUBLICATIONS

Lin et al., "Preparation of Potassium Ferricyanide by Electrochemical Method", Huaxue Shiji (no month, 1992), vol. 14, No. 6, pp. 379-380.*

International Search Report and Written Opinion of the International Searching Authority, International Application No. PCT/US08/71465, International Filing Date Jul. 29, 2008.

Garver et al., "Catalyzed Oxidative Nitration of Nitronate Salts," J. Org. Chem. 1985, 50, 1699-1702.

Kornblum et al., "Oxidative Substitution of Nitroparaffin Salts," J. Org. Chem. 1983, 48, 332-337.

Ogibin et al., "Electrochemical synthesis of geminal azidonitro compounds," Russian Chemical Bulletin, International Edition, vol. 53, No. 11, pp. 2558-2563, Nov. 2004.

(Continued)

*Primary Examiner*—Edna Wong
(74) *Attorney, Agent, or Firm*—TraskBritt

(57) ABSTRACT

A method for the electrochemical synthesis of dinitro compounds is disclosed. The method comprises using an anode to oxidize an inactive chemical mediator, such as a ferrocyanide ($Fe(CN)_6^{-4}$) ion, to an active chemical mediator or oxidizing agent, such as a ferricyanide ($Fe(CN)_6^{-3}$) ion, in the presence of a differential voltage. The oxidizing agent reacts with a nitro compound and a nitrite ion to form a geminal dinitro compound. The anode may continuously oxidize ferrocyanide to regenerate active ferricyanide, thus keeping sufficient amounts of ferricyanide available for reaction.

20 Claims, 4 Drawing Sheets

OTHER PUBLICATIONS

Serdp, "Clean Electrochemical Synthesis of AlkyInitro Compounds," Pollution Prevention pp. 1460, Nov. 11, 2005, 1 page.
Wright et al., "Electrolytic Preparation of GEM-Dinitroparaffins," Tetrahedron, 1963, vol. 19 Suppl. 1, pp. 3 to 15, Pergamon Press Ltd.
English translation of PL 103621 B1, Publication Date Mar. 13, 1978 to Matacz et al.; foreign language version cited by Examiner Mar. 23, 2009 Office Action PTO-892; translation received Sep. 22, 2009.
English translation of Lin et al., "Study on Preparation of Potassium Ferricyanide by Electrochemical Method", Huaxue Shiji (no month, 1992), vol. 14, No. 6, pp. 379-380; foreign language version cited by Examiner Mar. 23, 2009 Office Action PTO-892; translation received Sep. 22, 2009.

* cited by examiner

METHODS FOR PERFORMING ELECTROCHEMICAL NITRATION REACTIONS

GOVERNMENT RIGHTS

This invention was made with government support under Contract No. DE-AC07-05ID14517 awarded by the United States Department of Energy. The government has certain rights in the invention.

FIELD OF THE INVENTION

The present invention relates to methods for performing electrochemical nitration reactions. More specifically, embodiments of the present invention relate to the electrochemical synthesis of geminal dinitro compounds by oxidative nitration of a nitro compound.

BACKGROUND

Geminal dinitro compounds are precursors for energetic plasticizers used in the manufacture of explosive materials and propellant compositions for defense and industrial applications. For example, 2,2-dinitro-1-propanol (DNPOH) is used in the synthesis of energetic plasticizer compounds, such as bis(dinitropropyl)-acetal (BDNPA) and bis(2,2-dinitropropyl)-acetal/bis(2,2-dinitropropyl)formal (BDNPF). Geminal dinitro compounds may be synthesized from a nitroparaffin starting material. The synthesis of the geminal dinitro compound DNPOH from the nitroparaffin starting material 2-nitroethane involves the following two chemical reactions:

$$CH_3CH_2NO_2+NO_2^- \rightarrow CH_3CH(NO_2)_2 \quad \text{(Reaction 1)}$$

$$CH_3CH(NO_2)_2+H_2CO \rightarrow CH_3CH(NO_2)_2CH_2OH \quad \text{(Reaction 2)}$$

As shown in Reaction 1, 2-nitroethane is converted to 1,1-dinitroethane by oxidative nitration of the nitro substituted carbon. Condensation of 1,1-dinitroethane with formaldehyde results in the formation of DNPOH, as shown in Reaction 2. Reaction 2 is a well established reaction having yields exceeding 95%.

The oxidative nitration of the nitroparaffin shown in Reaction 1 is an industrially significant reaction in the synthesis of geminal dinitro compounds. One method of forming geminal dinitro compounds is by chemical oxidation of the 2-nitroethane. The oxidizing source for the nitration reaction is conventionally provided by a primary chemical oxidizer. As the primary chemical oxidizer is used during the reaction, a secondary chemical oxidizer is used to regenerate the primary chemical oxidizer to perform additional reactions. Thus, formation of geminal dinitro compounds by chemical oxidation results in a large volume of corrosive, inorganic salt waste. Moreover, the reaction volume is limited by the amount of chemical oxidizer available.

U.S. Pat. No. 2,997,504 to Shechter et al. describes a method of preparing a gem polynitro compound by reacting a nitronate salt and silver or mercury ions. The nitronate salt of a primary or secondary nitroparaffin is reacted with silver nitrate and an inorganic nitrite to produce a geminal dinitro compound and metallic silver.

C. M. Wright and D. R. Levering, "Electrolytic Preparation of Gem-Dinitroparaffins," Tetrahedron, 19(Suppl. 1):3-15 (1963), describes an electrolytic process for the preparation of geminal dinitroparaffins via electrolytic oxidative substitution of a nitro compound salt using a silver (Ag) mediator as follows:

$$R\overline{C}—NO_2+Ag^+ \rightarrow R\dot{C}—NO_2+Ag^0 \quad \text{(Reaction 3)}$$

$$R\dot{C}—NO_2+NO_2^- \rightarrow RC—(NO_2)_2^- \quad \text{(Reaction 4)}$$

$$RC—(NO_2)_2^-+Ag^+ \rightarrow RC—(NO_2)_2+Ag^0 \quad \text{(Reaction 5)}$$

The silver anode is electrolytically oxidized to generate silver ions which react with nitrite ions and ethylnitronate ions to form 1,1-dinitroethane and silver metal, as shown in Reaction 3. This initial electron transfer creates a radical from the nitroparaffin ion. Nucleophilic attack on this radical by a nitrite ion ($NO_2^-$) generates a dinitro-intermediate, such as that shown in Reaction 4. The dinitro-intermediate is oxidized to the geminal dinitro compound, as shown in Reaction 5.

After prolonged electrolysis, the deterioration of the silver anode and precipitation of silver powder in the bottom of the anode compartment was observed. Thus, this electrolytic process may be impractical for industrial use due to the high cost of the silver consumed during the reaction.

Komblum et al., "Oxidative Substitution of Nitroparaffin Salts," J. Org. Chem, 48:332-337 (1983) describes that α,α-dinitro compounds, α-nitro sulfones, and α-nitro nitriles are obtained when nitroparaffin salts are coupled to nitrite, benzenesulfinate, and cyanide ions by the agency of potassium ferricyanide. The amount of potassium ferrocyanide limits the amount of dinitro compound that may be synthesized.

U.S. Pat. No. 4,910,322 to Grakauskas et al., describes a method for converting nitroalkanes to gem-dinitro compounds using oxidative nitration. An organic nitro compound is reacted with a source of nitrite ions in the presence of a chemical oxidizing agent, such as sodium persulfate ($Na_2S_2O_8$) and potassium persulfate ($K_2S_2\mathbf{0}_8$), and a catalytic amount of an alkali metal ferricyanide. The chemical oxidizing agent is consumed during the reaction, adding additional expense and creating substantial waste to the process.

Despite the existence of methods known in the art for chemically synthesizing geminal dinitro compounds, there remains a need in the art for methods that produce substantial yields of geminal dinitro compounds while reducing or eliminating waste and expense. Thus, improved methods of performing oxidative nitration reactions are desirable.

BRIEF SUMMARY OF THE INVENTION

In one embodiment, the present invention comprises a method of nitrating a nitro compound. The method comprises oxidizing a chemical mediator at an anode in the presence of a voltage to produce an oxidizing agent. The oxidizing agent is reacted with a nitro compound and a nitrite ion source in a solution between the anode and a cathode to form a geminal dinitro compound.

In another embodiment, the present invention comprises a method of nitrating a nitro compound. The method comprises forming an oxidizing agent by electrochemically oxidizing a chemical mediator and reacting a nitro compound with the oxidizing agent and a nitrite ion source to form a geminal dinitro compound.

BRIEF DESCRIPTION OF THE SEVERAL VIEWS OF THE DRAWINGS

While the specification concludes with claims particularly pointing out and distinctly claiming that which is regarded as the present invention, the advantages of this invention may be more readily ascertained from the following description of the invention when read in conjunction with the accompanying drawings, in which:

DETAILED DESCRIPTION OF THE INVENTION

Embodiments of methods of performing an electrochemical nitration reaction according to the invention are disclosed. Embodiments of the method may be useful in the synthesis of a geminal dinitro compound from a nitro compound. The term "geminal dinitro compound," as used herein, means and includes an organic compound having two nitro (—$NO_2$) functional groups attached to the same carbon (C). As used herein, the term "nitro compound" means and includes an organic compound having at least one nitro functional group.

The electrochemical nitration reaction may be performed using a chemical mediator as an electron transfer shuttle and an anode as an oxidizing source. The chemical mediator may move between an active form and an inactive form. When a current is passed through the anode, the inactive chemical mediator may be oxidized at the anode to form an active chemical mediator, which functions as an oxidizing agent. Alternatively, the active chemical mediator may be initially added to the reaction, thus bypassing oxidation at the anode. A molecule of the oxidizing agent may react directly with the nitro compound creating a free radical. While not wishing to be bound by any particular theory, it is believed that a second molecule of the oxidizing agent reacts with a complex that may include the nitro compound, a nitrite ion and the oxidizing agent during the nitration reaction. Thus, two molecules of the oxidizing agent may be involved in the nitration reaction and may be reduced to their inactive form during the process. The electrochemical nitration reaction may be performed using any type of device suitable for performing electrolytic or electrochemical reactions. Such devices are known in the art and, therefore, are not described in detail herein.

Figure 1:
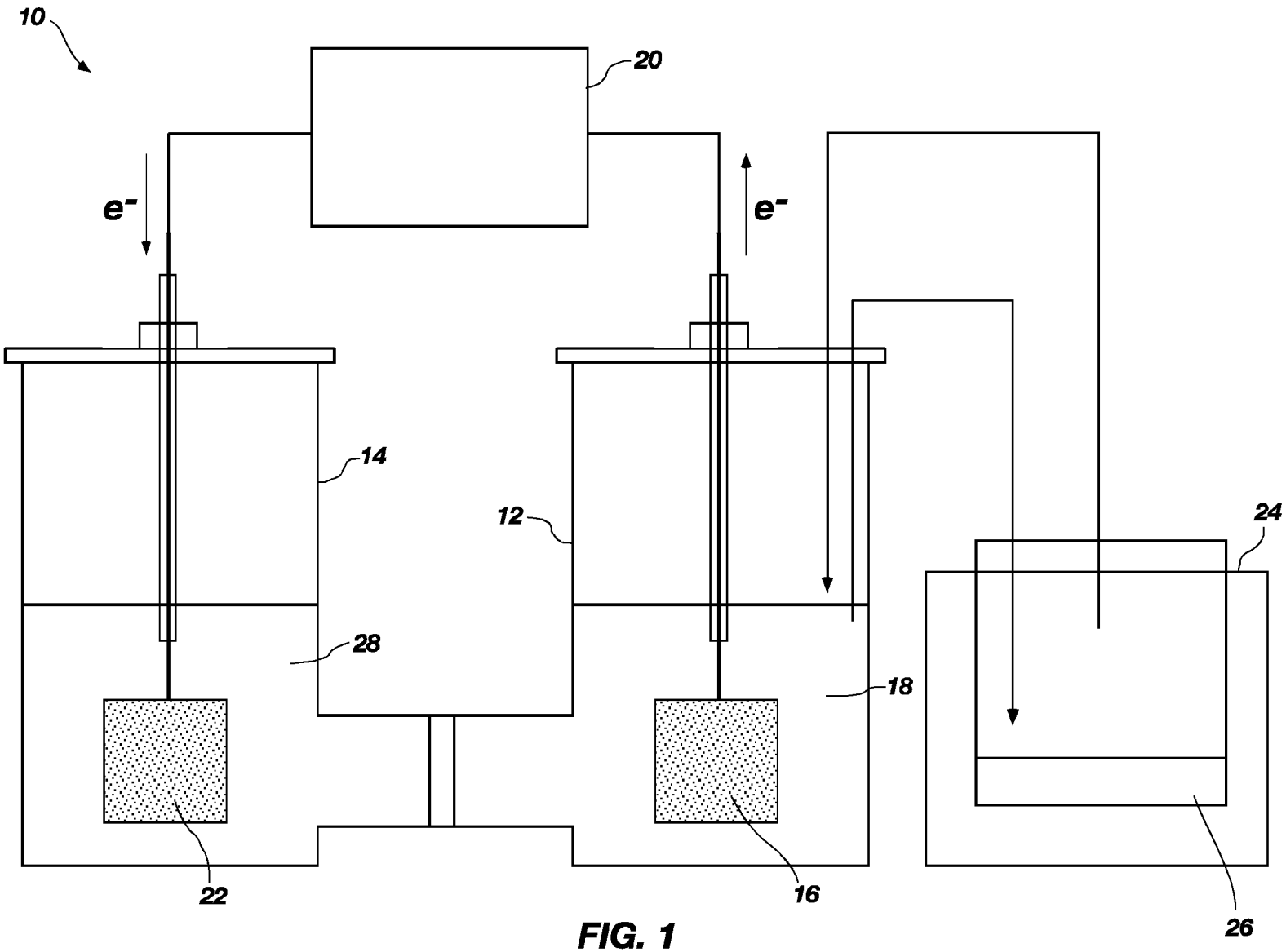
FIG. 1 is a schematic representation of an electrochemical cell that may be employed in an implementation of an embodiment of the present invention.

By way of non-limiting example, the electrochemical nitration reaction may be performed in an electrochemical cell 10, such as that shown in FIG. 1. The electrochemical cell 10 may include a cathode compartment 14 and an anode compartment 12. The cathode compartment 14 may contain a cathode 22 formed from a metal, such as nickel, and a hydroxide-containing cathode solution 28. The cathode solution 28 may include potassium hydroxide (KOH) or sodium hydroxide (NaOH) at a concentration of about 0.5 M. In some examples, a reference electrode (not shown), such as an Ag/AgCl electrode, may be used to determine the electrode potential of the electrochemical cell 10. The anode compartment 12 of the electrochemical cell 10 may be equipped with an anode 16 formed from a material suitable for oxidizing the chemical mediator. The anode 16 may be formed from or coated with a material including, but not limited to, platinum, gold, palladium, rhodium, iridium, ruthenium, boron-doped diamond thin films, graphite, carbon black, glassy carbon, carbon fibers and related carbonaceous materials.

An anode solution 18 including the nitro compound, a nitrite ion source and the chemical mediator in an aqueous hydroxide solution may be added to the anode compartment 12. The nitro compound and nitrite ion source may be added to the aqueous hydroxide solution prior to addition of the chemical mediator. The chemical mediator may be added to the anode solution 18 at substantially the same time the electrochemical nitration reaction is to be performed.

The nitro compound may be an organic compound having the general formula $R_1$—$CH_2$—$NO_2$ or $R_1$—(HC $NO_2$)—$R_2$, where each of $R_1$ and $R_2$ is independently selected from an alkyl group, an aryl group, an alkoxy group, a carboxyl group or a hydroxyl group. Depending on the geminal dinitro compound to be formed, suitable nitro compounds include, but are not limited to, nitro-alkanes, nitro-alkenes, nitro-alkynes, nitro-aldehydes, nitro-ketones, nitro-alcohols, nitro-carboxylic acids, nitro-cyclic compounds, nitro-ethers, nitro-polyethers, nitro-polyenes and nitro-polymers, nitro-aromatics, nitro-amines, nitro-carbohydrates, nitro-heterocyclic compounds, and combinations and isomers thereof. For example, nitro compounds, such as 1-nitroethane, 1-t-butyl-3-hydroxymethyl-3-nitroazetidine, 2-nitroethane, 2-nitropropane, 2-nitropropyl methyl ether, 3-nitrooxetane, 2-nitro-1,3-diethoxypropane, 1-nitrocyclohexane, 1-nitrocyclopentane, 2,2-dimethyl-5-nitro-1,3-dioxane, 1-nitrobutane, 2-nitrobutane, 2-nitropropane, nitrocyclohexane, methyl nitrate, ethylnitrate, 2-propyl nitrate, 1-propyl nitrate, 2-nitro hexane, 5-nonyl nitrate, 2-pentyl nitrate, 2-methoxyethyl nitrate, 1-methyl-2-methoxyethyl nitrate, 3-nitropropionic acid, 2-nitropropionate, nitro-cycloalkyl, nitro alkyl, nitro-aryl, nitro-alkaryl, nitroaralkyl, nitro-alkoxy, nitro-alkyl ethers, nitro-alkyl esters, and nitro-carboxylic acid esters, 2-nitrobutyrate, and phenylnitromethane, may be used as starting materials in the electrochemical reaction. The concentration of the nitro compound in the anode solution 18 may be, for example, within the range of from about 0.1M to about 1.8M.

The nitrite ion source may be provided to the anode solution 18 in the form of an inorganic nitrite ion or a salt of nitrous acid. Examples of nitrite ion sources include, but are not limited to, potassium nitrite ($KNO_2$), sodium nitrite ($NaNO_2$), lithium nitrite ($LiNO_2$), ammonium nitrite ($NH_4NO_2$), calcium nitrite ($Ca(NO_2)_2$), magnesium nitrite ($Mg(NO_2)_2$) or combinations thereof. The anode solution 18 may contain the nitrite ion source and the nitro compound in a ratio of from about 1:1 to about 4:1. In one embodiment, the anode solution 18 contains the nitrite ion source, such as potassium nitrite, and the nitro compound, such as 2-nitroethane, in a ratio of about 4:1.

Inorganic compounds that occur as salts and enable electron transfer may be employed as chemical mediators and oxidizing agents in the electrochemical nitration reaction. By way of non-limiting example, the chemical mediator may be potassium ferrocyanide ($K_4(Fe(CN)_6)$, ammonium ferrocyanide ($(NH_4)_4Fe(CN)_6$), iron (III) ferrocyanide ($Fe_7(CN)_{18}$), sodium ferrocyanide ($Na_4Fe(CN)_6$), or combinations thereof. The anode solution 18 may contain the chemical mediator in an amount in a range or from at least a catalytic amount to the limit of solubility in the anode solution 18. In one embodiment, the chemical mediator is potassium ferrocyanide. Alternatively, an oxidizing agent, such as ferricyanide ions, may be initially added to the anode solution 18.

By way of non-limiting example, the aqueous hydroxide solution may include an alkali metal hydroxide, such as potassium hydroxide, sodium hydroxide or combinations thereof. The aqueous hydroxide solution may contain, for example, an amount of the alkali metal hydroxide sufficient to maintain the pH of the anode solution 18 in a range of from about pH 9 to about pH 13. In solution, the alkali metal hydroxide dissociates to alkali metal and hydroxide ions. The hydroxide ions may deprotonate a hydrogen from the nitro-substituted carbon atom of the nitro compound. By way of non-limiting example, the aqueous hydroxide solution contains a ratio of potassium hydroxide to nitro compound of greater than about 2:3. For example, the ratio of potassium hydroxide to nitro compound may be from about 2:6 to about 1:1. In one embodiment, the ratio of potassium hydroxide to nitro compound may be 7:8.

A power source 20, such as a potentiostat or a DC power supply, may be used to apply the voltage between the anode 16 and the cathode 22 in the electrochemical cell 10. For example, the electrochemical cell 10 may be run at a constant current of about 50 $mA/cm^2$ or a constant potential of from about 0.2 Volt vs. Ag/AgCl to about 1 Volt vs. Ag/AgCl. By way of non-limiting example, a voltage of about 0.6 Volt v. Ag/AgCl may be applied.

Once combined in the anode solution 18, the chemical mediator may dissociate to form a stable ion, such as the ferrocyanide ion. Due to the solubility of the chemical mediator, the electrochemical nitration reaction may be conducted in a conventional electrolysis cell. In the presence of a voltage, the chemical mediator ion may react at the surface of the anode 16, which acts as an oxidizing agent to form an oxidizing agent. An electron is transferred from the chemical mediator ion to the anode 16, converting the chemical mediator ion to the oxidizing agent. Where a ferricyanide salt (such as potassium ferricyanide) is employed to start the reaction, this oxidation step does need not occur and the reaction may proceed in the same manner described below.

Because the oxidation/reduction of the chemical mediator is a reversible reaction with facile electrochemical kinetics, regeneration of the oxidizing agent is enabled by the anode 16. Moreover, the chemical mediator employed in accordance with embodiments of the invention may be much less expensive than other mediators, such as silver and platinum, which are conventionally expended during nitration reactions. Thus, the cost associated with loss of the oxidizing agent, as well as disposal of the oxidizing agent, may be substantially decreased using the electrochemical nitration reaction described herein.

While the examples herein describe the electrochemical nitration reaction using potassium ferrocyanide as the chemical mediator, other chemical compounds, as previously described, may be used as the chemical mediator. When a current is applied between the anode 16 and the cathode 22, the anode 16 may oxidize the ferrocyanide ions ($Fe(CN)_6^{-4}$) to ferricyanide ions ($Fe(CN)_6^{-3}$) by electron transfer. Deprotonation of the nitro compound to form a nitro compound ion may be performed, for example, by a hydroxide ion. A ferricyanide ion may react with the nitro compound ion to form a radical as shown in the following reaction:

$$R\overline{C}—NO_2+Fe(CN)_6^{-3}\rightarrow R\dot{C}—NO_2+Fe(CN)_6^{-4} \quad \text{(Reaction 6)}$$

Without wishing to be bound by any particular theory, it is believed that the formation of a complex between the ferricyanide ions and the nitro compound enables an electron transfer to form the radical. During the reaction shown in Reaction 6, ferricyanide ions oxidize the nitro compound ion while being simultaneously reduced to ferrocyanide ions. The transfer of electrons from the nitro compound ion to the ferricyanide results in the generation of the ferrocyanide, as shown in Reaction 6. The oxidized radical formed in Reaction 6 may react with a nitro group as follows:

$$R\dot{C}—NO_2+NO_2^-\rightarrow RC—(NO_2)_2^- \quad \text{(Reaction 7)}$$

As shown in Reaction 7, the addition of the second nitro group to the radical may form the geminal dinitro compound. Because the regenerated ferrocyanide may be repeatedly reduced at the anode 16 to form ferricyanide, the electrochemical nitration reaction may be repeated.

$$RC—(NO_2)_2^-+Fe(CN)_6^{-3}\rightarrow RC(NO_2)_2+Fe(CN)_6^{-4} \quad \text{(Reaction 8)}$$

In one embodiment, the anode solution 18 includes 0.8 M 2-nitroethane ($C_2H_5NO_2$), 0.8 M potassium hydroxide, 3.2 M potassium nitrite, and 0.16 M potassium ferrocyanide. The anode solution 18 may be added to the anode compartment 12 including a platinum-coated titanium anode 16. A voltage of about 0.6 V is applied continuously between the anode 16 and cathode 22. In solution, the potassium ferrocyanide may dissociate into free potassium ions ($K^+$) and ferrocyanide ions, which are oxidized to ferricyanide ions at the anode 16. The ferricyanide ions may react with the 1-nitroethane and potassium nitrite, resulting in the formation of 1,1-dinitroethane. To form DNPOH, the 1,1-dinitroethane may be reacted with formaldehyde ($H_2CO$) to obtain a yield of 69% DNPOH at a value of 100% current efficiency.

While the examples herein describe the electrochemical nitration reaction using the starting material 1-nitroethane to synthesize the geminal dinitro compound 1,1-dinitroethane, a variety of compounds may be synthesized from different starting materials. By way of non-limiting example, the electrochemical nitration reaction may be employed to synthesize 1,3,3-trinitroazetidine (TNAZ), 2,2-dinitropropane, 2,2-dinitropropyl methyl ester, 3,3-dinitrooxetane, 2,2-dinitro-1,3-diethoxypropane, 1,1-dinitrocyclohexane, 1,1-dinitrocyclopentane, 2,2-dimethyl-5,5-dinitro-1,3-dioxane, 1,1-dinitrobutane, 2,2-dinitrobutane, 2-cyano-2-nitropropane, or 1-nitro-1-(phenylsulfonyl)cyclohexane.

By employing the anode 16 as the oxidizing source for the conversion of the chemical mediator from the inactive state to the active state, the expense and waste products associated with chemical oxidizers may be reduced or eliminated. Because the anode 16 supplies the oxidizing power for the reaction by converting inactive ferrocyanide ions to active ferricyanide ions, a catalyic amount of the chemical mediator may be used and the anode 16 does not substantially deteriorate during the reaction. Thus, both the chemical mediator and the anode 16 may be repeatedly used to conduct the electrochemical nitration reactions.

Referring again to FIG. 1, the electrochemical nitration reaction may be conducted using various techniques of performing electrochemical reactions. The electrochemical cell 10 for performing a batch-scale reaction may be used in a continuous-loop by circulating the anode solution 18 to a container 24. The anode solution 18 may be transferred, for example, using a small peristaltic pump (not shown). The container 24 may be a separate vessel capable of being chilled, such as a crystallization cell or crystallization container. The container 24 may chilled by placing the container 24 in a chilled bath (not shown). By way of non-limiting example, the anode solution 18 may be continuously circulated to the container 24, which is maintained at a temperature of about 0° C. using a chiller bath. The geminal dinitro compound 26 may precipitate out of the anode solution 18 for collection in the container 24. Once the geminal dinitro compound 26 is removed from the anode solution 18, the remaining solution may be transferred back to the anode compartment 12. Additional nitro compound may be added to the anode solution 18 and the reaction may be continuously repeated by circulating the anode solution 18 as described above.

Precipitation and collection of the geminal dinitro compound 26 from the anode solution 18 may improve the yield of the geminal dinitro compound 26 by preventing undesirable side reactions and improving the reaction equilibrium. Because the geminal dinitro compound 26 may be collected in the container 24, it may be effectively removed from the electrolysis cell 10 without causing undesirable electrode coating and, thus, may increase the effective anode area and reaction rate.

Figure 2:
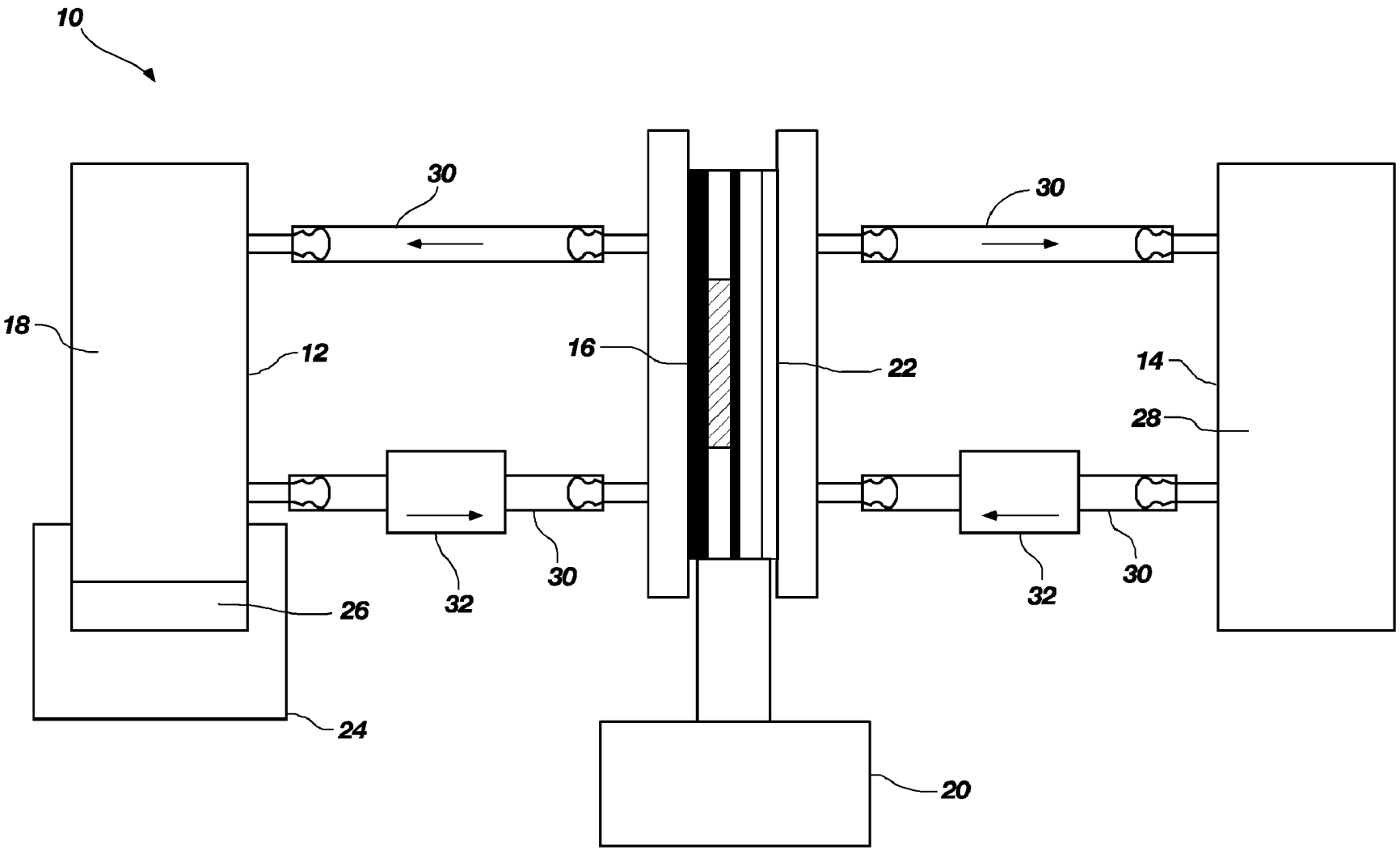
FIG. 2 is a schematic representation of an electrochemical cell that may be employed in an implementation of another embodiment of the present invention.

Referring to FIG. 2, a flow process device may be used to continuously perform the electrochemical nitration reaction. The electrochemical cell 10 may include the anode compartment 12 containing the anode solution 18 and the cathode compartment 14 containing the cathode solution 28, as described above. The anode compartment 12 may additionally include a container 24 for the collection of precipitate. The anode solution 18 may be introduced to the anode compartment 12 through flow chambers 30 connected by a pump 32. A power supply 20 may be used to apply a current between the anode 16 and cathode 22. The anode solution 18 may be continuously cycled to the anode 16 from the anode compartment 12. At the anode 16, the chemical mediator is oxidized to the active state to form an oxidizing agent that performs the electrochemical nitration as described with respect to FIG. 1. In the anode compartment 12, the geminal dinitro compound 26 may be collected as it forms in the container 24. Additional nitro compound may be continuously added to the anode solution 18 in an amount less than the solubility limit to continue the electrosynthesis of the geminal dinitro compounds in the flow process device.

Oxidative nitration reactions performed on an anode without a chemical mediator have been shown to be sensitive to the electrode. Without wishing to be bound by theory, it is believed that, in the absence of the chemical mediator, a complex may not be formed directly on the anode, resulting in an increased energy barrier for the nitration reaction and requiring increased electrochemical potentials. Performing the reaction at higher electrochemical potentials may increase the formation of undesirable side reactions and, in turn, decrease the yield of the geminal dinitro compound. By employing the chemical mediator, such as the ferrocyanide, the electrochemical nitration reaction described herein may be performed at substantially lower potentials and, thus, may produce a substantially greater product yield while forming minimal undesirable by-products.

In the presence of a chemical mediator, the electrochemical nitration reaction provides a substantially greater 1,1-dinitroethane yield and enables the electrochemical reaction to run at much lower cell potentials than direct oxidation on an electrode. Because the method described herein enables a chemical mediator, such as ferrocyanide, to be continuously reused and does not utilize additional chemical oxidizers as an oxidizing source, the formation of undesirable waste products and reaction by-products is substantially reduced. Thus, the electrochemical nitration reaction may be more cost effective than other processes by eliminating the initial cost of the chemical oxidizer as well as the cost of disposing the spent oxidizer.

The following examples are illustrative of representative, non-limiting embodiments of the present invention. Thus, these examples are not exhaustive or exclusive as to the scope of this invention.

EXAMPLES

The following equipment and methods were used to conduct the electrolysis and cyclic voltammetry experiments described in Examples 1-3. The potentiostat was a Solartron Model 1287A, which is commercially available from Solartron Analytical (Farnborough, Hampshire, UK), operated using CORRWARE® software package, which is available from Scribner Associates Inc. (Southern Pines, N.C.).

The batch electrolysis cell was a three-compartment type with porous frits separating each compartment. Anode and cathode compartments were approximately 35 mL, whereas the reference compartment was smaller in volume. The entire cell volume was not always utilized. Solutions were stirred using a TEFLON® coated stir bar. A platinum mesh microelectrode with dimensions of approximately 3.1 cm by 2.7 cm was used as an anode. The mesh (52 mesh, 0.1 mm wire) was folded over and spot welded to double the surface area. The estimated surface area was calculated to be 42.9 $cm^2$. A similar platinum mesh cathode was utilized. Electrodes were cleaned by soaking in 50% nitric acid solution before use. Gel type Ag/AgCl reference electrodes, which are commercially available from Bioanalytical Systems, Inc. (West Lafayette, Ind.), were used to measure electrochemical potential.

Potassium hydroxide or sodium hydroxide, both commercially available from Fisher Scientific (Fair Lawn, N.J.), was combined with a fraction of the total nanopure water volume (~10 to 20%) and stirred until dissolved. Nitroethane (>99%) available from Alpha Aesar (Ward Hill, Mass.) was added slowly to the hydroxide solution and stirred for at least 30 minutes to form the nitroethanate anion. The remaining water and sodium nitrite ($NaNO_2$) were added and the solution stirred until dissolved. This solution was used in the anode compartment. The anode solution was stirred during the reaction using a magnetic stir bar. The cathode and reference compartments contained 0.5 M potassium hydroxide or 0.5 M sodium hydroxide.

The electrolysis was performed in both potentiostatic and galvanostatic control. Following the reaction, the anode solution containing the 1,1-dinitroethanate ion was removed from the anode compartment after completing the electrolysis reaction. To produce DNPOH, the pH of the anode solution was adjusted to pH>10 (if necessary), and an excess amount (2 moles formaldehyde to 1 mole of 1,1-dinitroethane) of 37% formaldehyde, which is commercially available from Sigma-Aldrich (St. Louis, Mo.), was added. After the reaction, the solution was neutralized to a pH in a range of from about pH 4 to about pH 5 with 1 M phosphoric acid ($H_3PO_4$). DNPOH was extracted into ethyl acetate, which was obtained commercially from Acros Organics (Morris Plains, N.J.), for GC-MS and NMR analysis.

The ethyl acetate extracts were analyzed by GC-MS, GC, and NMR. GC-MS analysis was performed using a Shimadzu model GCMS-QP2010, which is commercially available from Shimadzu Scientific Instruments (Columbia, Md.). The column used was a Restek XTI-5 (cross-bonded 5% diphenyl-95% dimethyl polysiloxane), which is available commercially from Restek Corporation (Bellefonte, Pa.), with the dimensions of 30 m×0.25 mm ID×0.25 μm. The standards preparation was performed using 95% 2,2-dinitro-1-propanol, ≧97% 2-nitro-1-propanol, 99.5% nitroethane and acetic acid, which are commercially obtained from Sigma-Aldrich (St. Louis, Mo.).

NMR data (1H and 13C{1H}) were acquired on a Bruker DMX 300WB spectrometer, commercially available from Bruker BioSciences Corporation (Billerica, Mass.), with a magnetic field strength of 7.04 Tesla corresponding to operating frequencies of 300.13 MHz (1H) and 75.48 MHz (13C). The NMR spectra were referenced internally utilizing an appropriate deuterated solvent. Diethyl ether-d-10, chloroform-d, and methylene chloride-d2 are each available from Cambridge Isotope Laboratories, Inc. (Andover, Mass.).

Example 1

Potassium Ferrocyanide Mediated Electrolysis Using a Batch-Scale Electrolysis Cell Solutions were prepared with either sodium or potassium salts (hydroxide and nitrite). While the reaction worked well for either cation, the use of potassium salts coupled with chilling of the cell in an ice bath produced the best results for overall product yield. Potassium ferrocyanide ($K_4[Fe(CN)_6].3H_2O$), commercially available from Alpha Aesar (Ward Hill, Mass.), was added just prior to initiating the electrolysis. Initial experiments were performed using a batch-cell process in the same electrolysis cell used for the direct oxidation experiments.

The anode solution volume was 20 mL and had the following composition: 0.8 M 2-nitroethane, 0.72 M potassium hydroxide, 3.2 M potassium nitrite and 0.16 M potassium ferrocyanide. The cathode and reference electrode solutions used 0.5 M potassium hydroxide.

Figure 3:
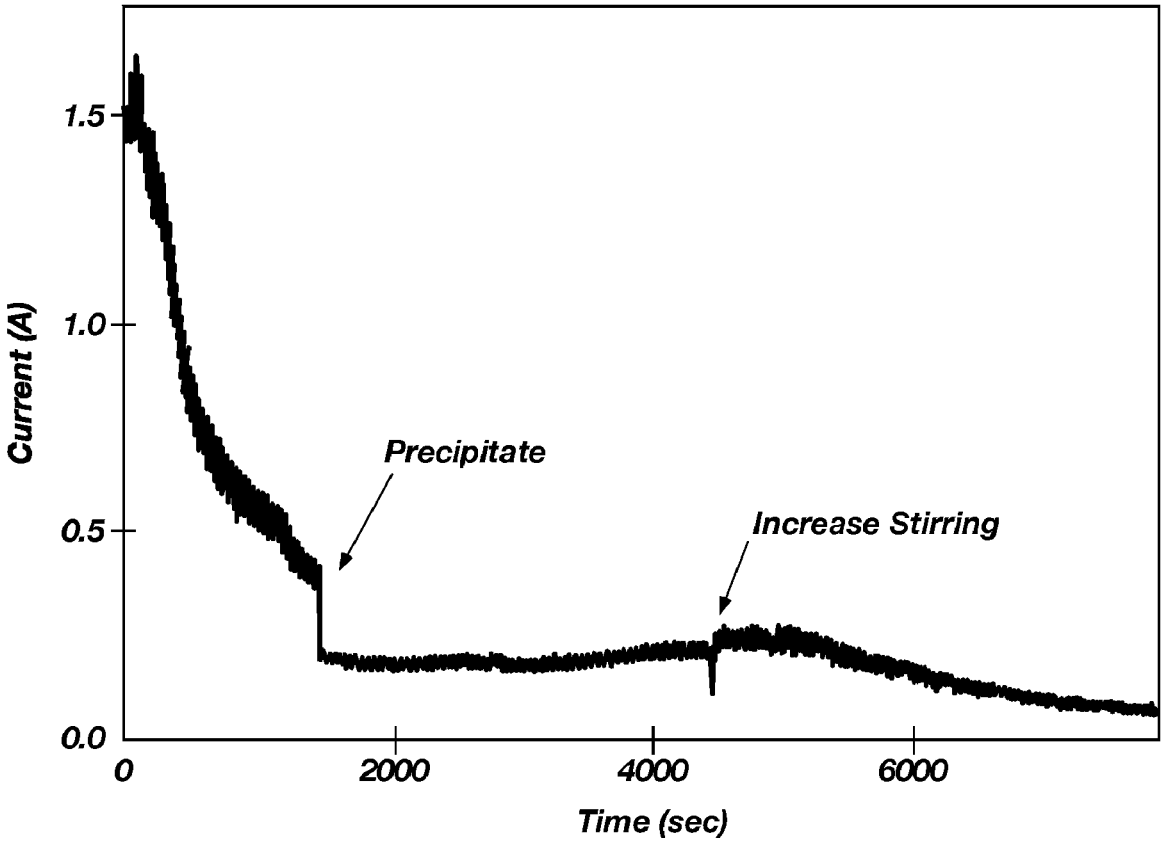
FIG. 3 is a plot of current versus time recorded during electrochemical synthesis of 1,1-dinitroethane by a method described herein according to the embodiment of FIG. 1.

During the reaction, there was a sharp drop in current at 23.7 min (1,427 seconds) due to precipitate formation of 1,1-dinitroethane product within the anode compartment. The precipitate was yellow in color and formed on surfaces including the electrode, which likely resulted in the observed current drop illustrated in FIG. 3. The reaction continued at a slower rate with slightly over two-thirds of the theoretical charge being passed before the reaction was stopped. Stirring was increased at 4458 seconds with very little increase in current. The 1,1-dinitroethane product was reacted with excess formaldehyde, resulting in a yield of 69% DNPOH, which provided a value of 100% current efficiency.

While not wishing to be bound by theory, it is believed that precipitation of the 1,1-dinitroethane product improves the yield by preventing further side reactions. Removal of the 1,1-dinitroethane product also improves the equilibrium for the reaction.

Example 2

Potassium Ferrocyanide Mediated Electrolysis Using a Continuous-Loop Electrolysis Cell The continuous-loop concept was tested using the same electrolysis cell with the anode solution continuously circulated to a separate chilled container (where precipitation of the product occurs) and back to the cell. FIG. 2 shows a diagram of the continuously circulated batch-cell configuration, which utilizes a separate container for precipitation of the potassium-salt of 1,1-dinitrothane. In a continuous-loop, the precipitate is formed in a chilled container separate from the electrolysis cell and, thus, is effectively removed from the system without electrode coating.

Figure 4:
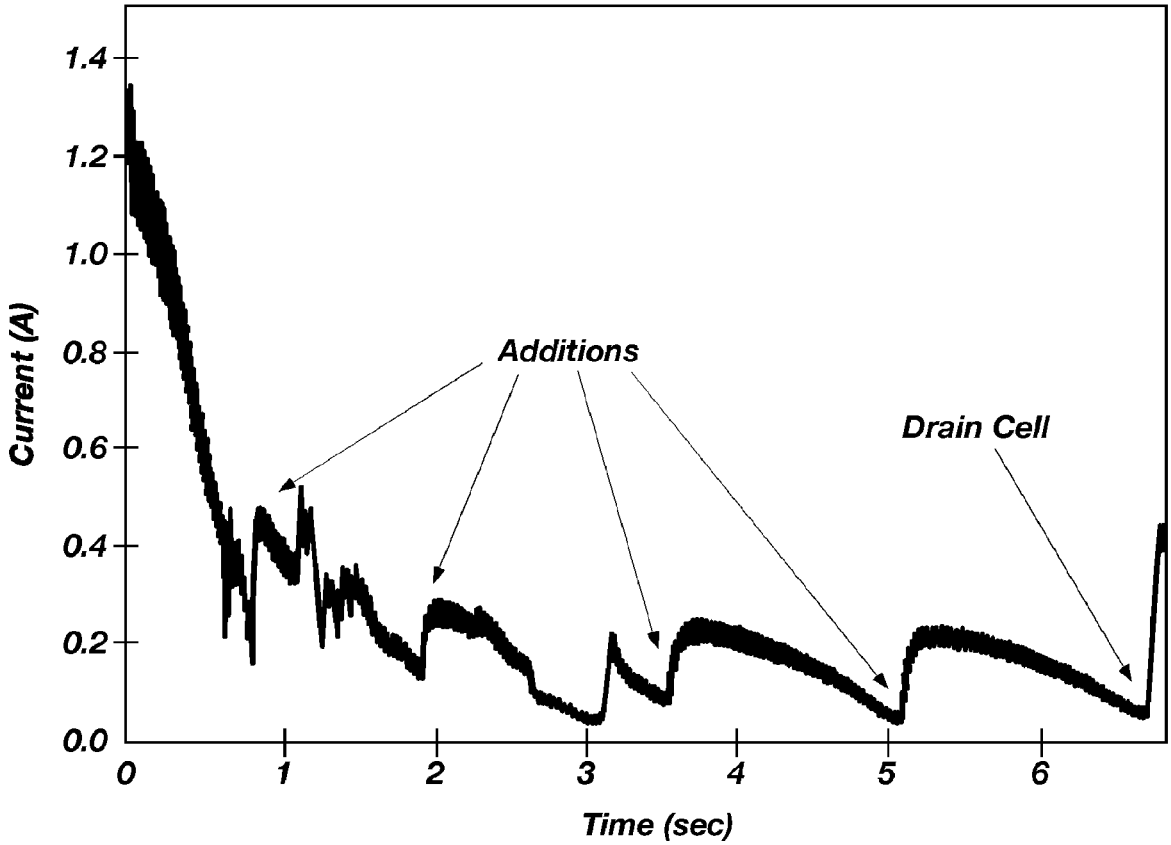
FIG. 4 is a plot of current versus time recorded during continuous electrosynthesis of 1,1-dinitroethane by a method described herein according to the embodiment of FIG. 2.

The initial anode solution composition was 0.8 M 2-nitroethane, 0.72 M potassium hydroxide, 3.2 M potassium nitrite, and 0.16 M potassium ferrocyanide. The solution was removed to the separate chilled container and returned back to the cell using small peristaltic pumps. The reaction was performed for 6.79 hours at 0.6 V with an initial solution volume of 60 mL, with 5 mL additions of a more concentrated solution containing 1.6 M 2-nitroethane, 1.7 M potassium hydroxide and 1.6 M potassium nitrite, made to the cell at the times indicated in FIG. 4. The additions increased the solution volume during the test and made balancing the anode and cathode solutions in the electrolysis cell difficult, and some disturbances in the cell were present other than those from solution addition. The current increased when the solution was drained from the cell while still under electrolysis (solution from the circulation loop was not returned to the cell), as shown in FIG. 4.

The anode solution was circulated to the separate chilled container using peristaltic pumps with a flow rate of 4.6 mL/min. The container was maintained at about 0° C. using a chiller bath. The 1,1-dinitroethane product precipitated in the container and was placed in an ice bath, forming long needles of bright yellow 1,1-dinitroethane potassium (K)-salt. After the electrolysis was completed, the precipitate and the spent solution from the electrolysis cell were reacted with excess formaldehyde at a pH greater than about pH 10 to produce DNPOH. While not wishing to be bound by a particular theory, it is believed that increased current resulted from the cathode solution, increasing the pH of the anode solution as it flowed into the anode to balance the fluid levels. Thus, maintaining a higher pH maintains the active deprotonated form of the nitroethanate ion.

The 1,1-dinitroethane product was reacted with excess formaldehyde, resulting in a total product yield of DNPOH of 57%. The current efficiency was calculated to be 91%.

Example 3 Comparative

Platinum Mediated Oxidative Nitration of 2-Nitroethane

Oxidative nitration of 2-nitroethane was performed on solutions with and without sodium nitrite using a platinum electrode. The solution without sodium nitrite contained 0.1 M nitroethane and 0.15 M sodium hydroxide. Four-tenths molar sodium nitrite was added to form the solution with sodium nitrite. The electrolysis of 2-nitroethane was attempted both at constant potential and constant current.

The anode was maintained at 1.6 V vs. Ag/AgCl. The current decreased very rapidly, indicating a decrease in kinetics with significant 2-nitroethane remaining in solution. Very low product yield was observed and most of the 2-nitroethane remained. When the electrolysis was performed using constant current (0.5 A), the potential quickly rose above 1.5 V within 5 minutes and slowly increased afterward to over 2.3 V. In addition to oxidation of the 2-nitroethane, it is expected that nitrite ($NO_2^-$) and hydroxide ($OH^-$) oxidation reactions also occur at the anode. An amber color was observed in solution after about 15 minutes of electrolysis, indicative of ethylnitrolic acid ($CH_3CHNO_2NOH$) formation. Generation of ethylnitrolic acid was observed previously in the electrolysis of 2-nitroethane on platinum anodes. Ethylnitrolic acid is a known photolysis product of 1,1-dinitroethane. A decrease in pH during the electrolysis was also observed. The color was observed to reversibly change with pH, from deep amber to yellow as the pH was lowered, with the amber color returning with the addition of sodium hydroxide.

Analysis of the product by GC-MS confirmed production of 1,1-dinitroethane. In addition, significant amounts of acetic acid were observed. It was observed that solution concentrations of 1,1-dinitroethane decreased and acetic acid concentrations increased if left overnight in the electrolysis solution. This degradation reaction was not investigated further but has been described in electrolysis reactions previously. Acetic acid was the final degradation product of the photolysis of 1,1-dinitroethane via degradation of ethylnitrolic acid.

To determine DNPOH yield, the condensation of 1,1-dinitroethane with formaldehyde was performed on the basic (pH>10) electrolysis solution, yielding DNPOH. This reaction was found to be relatively insensitive to conditions, but excess formaldehyde was added to promote complete reaction (stoichiometric ratios over 2:1 assuming 100% yield in oxidative nitration). The product was extracted and analyzed by GC-MS.

The highest yield achieved was 15% (of theoretical) for direct oxidative nitration of 2-nitroethane to 1,1-dinitroethane on platinum surfaces followed by condensation with formaldehyde to form DNPOH. The product yield resulting from platinum mediated oxidative nitration of 2-nitroethane was significantly less than the product yield obtained in the electrochemical synthesis described in Examples 1 and 2.

Example 4 Comparative $Ag^+/Ag^0$ Mediated Electrolysis of 2-Nitroethane

A silver bed electrolysis cell was used that included a 40 mL fine-frit Buchner funnel, which is commercially available from Thermo Fisher Scientific, Inc. (Waltham, Mass.). The silver bed anode was formed using 4-7 μm diameter silver powder, which is commercially obtained from Alpha Aesar. A platinum mesh feeder electrode (52 mesh, 0.1 mm wire) was inserted at the bottom of the Buchner funnel with approximately 2 grams of silver powder covering the platinum feeder electrode. The cathode compartment was tube-shaped with a fine porosity frit at the bottom facing the silver bed. A platinum flag electrode was used as the cathode. An Ag/AgCl reference electrode commercially available from Bioanalytical Systems, Inc. was utilized directly in the anode solution. The potential set point was 0.6 V with the measured potential plotted. The solution composition was 0.8 M 2-nitroethane, 0.72 M sodium hydroxide and 1.6 M sodium nitrite. The solution was continuously pumped from the collection flask back to the top of the cell.

The silver bed electrode was operated using both constant current and constant potential modes. The silver bed electrode provided reduced electrode potential, however, it was difficult to keep the cell at optimum conditions leading to very erratic plots with either constant current or constant potential operation. Thus, matching the flow rate and the current (reaction rate) through the cell proved difficult. Because the solution flow through the filter outpaced the reaction rate, the cell was operated by recirculation of the solution from the collection flask back to the top of the cell so that the solution was completely reacted. Thus, the cell operated essentially in a batch recirculation mode.

Blooming (fine particle formation) occurred, particularly in constant current operation, compromising the stability of the silver bed electrode. Such events were correlated with potential excursions above 1.0 V in constant current operation and led to silver precipitate formation in the filter exit and collection flask due to the deterioration of the electrode.

After the reaction was complete, the cell was rinsed with additional 0.5 M NaOH solution to remove the remaining product. Condensation of the 1,1-dinitroethane with formaldehyde formed DNPOH at a 57.6% molar yield and 75% current efficiency. Thus, the $Ag^+/Ag^0$ mediated electrolysis of 2-nitroethane resulted in a substantially similar product yield and substantially decreased current efficiency in comparison to those obtained in Example 1. In comparison with the electrochemical synthesis described in Example 2, the $Ag^+/Ag^0$ mediated electrolysis of 2-nitroethane resulted in a substantially decreased product yield and a substantially decreased current efficiency.

While the invention may be susceptible to various modifications and alternative forms, specific embodiments have been shown by way of example in the drawings and have been described in detail herein. However, it should be understood that the invention is not intended to be limited to the particular forms disclosed. Rather, the invention is to cover all modifications, equivalents, and alternatives falling within the spirit and scope of the invention as defined by the following appended claims.

What is claimed is:

1. A method of nitrating a nitro compound, comprising:

oxidizing a chemical mediator at an anode in the presence of a voltage to produce an oxidizing agent; and electrochemically reacting a nitro compound with the oxidizing agent and a nitrite ion source in a solution to form a geminal dinitro compound.

2. The method of claim 1, wherein oxidizing a chemical mediator at an anode in the presence of a voltage to produce an oxidizing agent comprises oxidizing the chemical mediator at an anode comprising at least one of platinum, gold, palladium, rhodium, iridium, ruthenium, boron-doped diamond thin films, graphite, carbon black, glassy carbon, carbon fibers and related carbonaceous materials.

3. The method of claim 1, further comprising regenerating the oxidizing agent by oxidizing the chemical mediator at the anode after electrochemically reacting the nitro compound with the oxidizing agent and the nitrite ion source.

4. The method of claim 1, wherein oxidizing a chemical mediator at an anode in the presence of a voltage to produce an oxidizing agent comprises oxidizing the chemical mediator in the presence of a voltage in the range of from about 0.2 Volt v. Ag/AgCl to about 1.0 Volt v. Ag/AgCl.

5. The method of claim 4, wherein oxidizing a chemical mediator at an anode in the presence of a voltage to produce an oxidizing agent comprises oxidizing the chemical mediator in the presence of a voltage of about 0.6 Volt v. Ag/AgCl.

6. The method of claim 1, wherein oxidizing a chemical mediator at an anode to produce an oxidizing agent comprises oxidizing a chemical mediator selected from the group consisting of potassium ferrocyanide, ammonium ferrocyanide, iron (III) ferrocyanide, sodium ferrocyanide, and combinations thereof at the anode to produce a ferricyanide ion.

7. The method of claim 1, wherein oxidizing a chemical mediator at an anode to produce an oxidizing agent comprises oxidizing potassium ferrocyanide at the anode to produce a ferricyanide ion.

8. The method of claim 1, wherein electrochemically reacting a nitro compound with the oxidizing agent and a nitrite ion source in a solution to form a geminal dinitro compound comprises electrochemically reacting the oxidizing agent with a nitro compound selected from the group consisting of 1-nitroethane, 1-t-butyl-3-hydroxymethyl-3-nitroazetidine, 2-nitroethane, 2-nitropropane, 2-nitropropyl methyl ether, 3-nitrooxetane, 2-nitro- 1,3-diethoxypropane, 1-nitrocyclohexane, 1-nitrocyclopentane, 2, 2-dimethyl-5-nitro-1, 3-dioxane, 1-nitrobutane, 2-nitrobutane, 2-nitropropane, nitrocyclohexane, methyl nitrate, ethylnitrate, 2-propyl nitrate, 1-propyl nitrate, 2-nitro hexane, 5-nonyl nitrate, 2-pentyl nitrate, 2-methoxyethyl nitrate, 1-methyl-2-methoxyethyl nitrate, 3-nitropropionic acid, 2-nitropropionate, phenylnitromethane, nitro-cycloalkyl, nitro alkyl, nitro-aryl, nitro-alkaryl, nitroaralkyl, nitro-alkoxy, nitro-alkyl ethers, nitro-alkyl esters, and nitro-carboxylic acid esters.

9. The method of claim 1, wherein electrochemically reacting a nitro compound with the oxidizing agent and a nitrite ion source in a solution to form a geminal dinitro compound comprises electrochemically reacting the oxidizing agent with 2-nitroethane.

10. The method of claim 1, wherein electrochemically reacting a nitro compound with the oxidizing agent and a nitrite ion source in a solution to form a geminal dinitro compound comprises electrochemically reacting the oxidizing agent with the nitro compound and a nitrite ion source selected from the group consisting of potassium nitrite, sodium nitrite, lithium nitrite, ammonium nitrite, calcium nitrite and magnesium nitrite.

11. The method of claim 1, wherein electrochemically reacting a nitro compound with the oxidizing agent and a nitrite ion source in a solution to form a geminal dinitro compound comprises electrochemically reacting a ferricyanide ion with 2-nitroethane and potassium nitrite in an aqueous potassium hydroxide solution.

12. The method of claim 1, wherein electrochemically reacting a nitro compound with the oxidizing agent and a nitrite ion source in a solution to form a geminal dinitro compound comprises electrochemically reacting the nitro compound with a ferricyanide ion and the nitrite ion source in the solution to form the geminal dinitro compound.

13. The method of claim 1, further comprising precipitating the geminal dinitro compound.

14. A method of nitrating a nitro compound, comprising:

forming an oxidizing agent by electrochemically oxidizing a chemical mediator in an anode compartment of an electrochemical cell; and electrochemically reacting a nitro compound with the oxidizing agent and a nitrite ion source in the anode compartment to form a geminal dinitro compound.

15. The method of claim 14, wherein forming an oxidizing agent by electrochemically oxidizing a chemical mediator in an anode compartment of an electrochemical cell comprises forming a ferricyanide ion by electrochemically oxidizing a chemical mediator selected from the group consisting of potassium ferrocyanide, ammonium ferrocyanide, iron (III) ferrocyanide, sodium ferrocyanide, and combinations thereof.

16. The method of claim 14, wherein forming an oxidizing agent by electrochemically oxidizing a chemical mediator in an anode compartment of an electrochemical cell comprises forming a ferricyanide ion by oxidizing potassium ferrocyanide with a platinum-coated titanium anode.

17. The method of claim 14, wherein forming an oxidizing agent by electrochemically oxidizing a chemical mediator in an anode compartment of an electrochemical cell comprises passing a current between an anode and a cathode and exposing the chemical mediator to the anode.

18. The method of claim 14, wherein forming an oxidizing agent by electrochemically oxidizing a chemical mediator in an anode compartment of an electrochemical cell comprises applying a voltage of from about 0.2 volts to about 1.0 volts between an anode and a cathode in the electrochemical cell.

19. The method of claim 14, wherein electrochemically reacting a nitro compound with the oxidizing agent and a nitrite ion source in the anode compartment to form a geminal dinitro compound comprises electrochemically reacting a nitro compound selected from the group consisting of 1-nitroethane, 1-t-butyl-3-hydroxymethyl-3-nitroazetidine, 2-nitroethane, 2-nitropropane, 2-nitropropyl methyl ether, 3-nitrooxetane, 2-nitro-1, 3-diethoxypropane, 1-nitrocyclohexane, 1-nitrocyclopentane, 2,2-dimethyl-5-nitro- 1,3-dioxane, 1-nitrobutane, 2-nitrobutane, 2-nitropropane, nitrocyclohexane, methyl nitrate, ethylnitrate, 2-propyl nitrate, 1-propyl nitrate, 2-nitro hexane, 5-nonyl nitrate, 2-pentyl nitrate, 2-methoxyethyl nitrate, 1-methyl-2-methoxyethyl nitrate, 3-nitropropionic acid, 2-nitropropionate, phenylnitromethane, nitro-cycloalkyl, nitro alkyl, nitro-aryl, nitro-alkaryl, nitroaralkyl, nitro-alkoxy, nitro-alkyl ethers, nitro-alkyl esters, and nitro-carboxylic acid esters with the oxidizing agent and the nitrite ion source in the anode compartment.

20. The method of claim 14, wherein electrochemically reacting a nitro compound with the oxidizing agent and a nitrite ion source in the anode compartment to form a geminal dinitro compound comprises electrochemically reacting 2-nitroethane with a ferricyanide ion and potassium nitrite in the anode compartment to form 1,1-dinitroethane.

* * * * *

UNITED STATES PATENT AND TRADEMARK OFFICE

CERTIFICATE OF CORRECTION

PATENT NO. : 7,713,401 B2
APPLICATION NO. : 11/836009
DATED : May 11, 2010
INVENTOR(S) : Tedd Edward Lister and Robert Vincent Fox It is certified that error appears in the above-identified patent and that said Letters Patent is hereby corrected as shown below:

On the title page:

In ITEM (56) References Cited:

OTHER PUBLICATIONS

Page 2, 1st column, 1st line of the 1st entry (line 1), change "Synthesis of AlkyInitro" to --Synthesis of Alkylnitro--

In the specification:

| | | |
|---|---|---|
| COLUMN 2, | LINE 20, | change "Komblum" to --Kornblum-- |
| COLUMN 2, | LINE 32, | change "($K_2S_2$**0**$_8$)," to --($K_2S_2O_8$),-- |
| COLUMN 8, | LINE 31, | change "or0.5 M" to --or 0.5 M-- |
| COLUMN 9, | LINES 13-14, | change "$(CN)_6$].$3H_2O$)," to --$(CN)_6$]·$3H_2O$),-- |
| COLUMN 9, | LINE 25, | change "23.7 min" to --23.7 minutes-- |
| COLUMN 9, | LINE 53, | change "1,1-dinitrothane." to --1,1-dinitroethane.-- |

In the claims:

| | | |
|---|---|---|
| CLAIM 18, COLUMN 14, | LINE 14, | change "1.0 volts" to --1.0 volt-- |

Signed and Sealed this
Twenty-second Day of October, 2013

Teresa Stanek Rea

Teresa Stanek Rea
*Deputy Director of the United States Patent and Trademark Office*